US006999713B2

(12) United States Patent
Kobayashi

(10) Patent No.: US 6,999,713 B2
(45) Date of Patent: Feb. 14, 2006

(54) METHOD FOR SETTING ROTATIONAL SPEED OF REGISTER ROLLERS AND IMAGE FORMING APPARATUS USING THE METHOD

(75) Inventor: Kazuhiko Kobayashi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/113,025

(22) Filed: Apr. 25, 2005

(65) Prior Publication Data

US 2005/0191103 A1 Sep. 1, 2005

Related U.S. Application Data

(62) Division of application No. 10/861,491, filed on Jun. 7, 2004.

(30) Foreign Application Priority Data

Jul. 2, 2003 (JP) ..... 2003-190539
Aug. 29, 2003 (JP) ..... 2003-307079

(51) Int. Cl.
*G03G 15/00* (2006.01)

(52) U.S. Cl. ..... 399/394; 399/396; 399/330.1

(58) Field of Classification Search ..... 399/388, 399/394, 396, 308, 313, 301–303, 162–165; 347/116
See application file for complete search history.

(56) References Cited

U.S. PATENT DOCUMENTS

| | | | | |
|---|---|---|---|---|
| 5,983,066 | A * | 11/1999 | Abe et al. | 399/394 |
| 6,137,981 | A * | 10/2000 | Janssens et al. | 399/301 |
| 6,167,221 | A * | 12/2000 | Kobayashi | 399/107 |
| 6,330,424 | B1 * | 12/2001 | Chapman et al. | 399/394 |
| 6,708,017 | B1 * | 3/2004 | Yamanaka et al. | 399/301 |
| 6,714,224 | B1 * | 3/2004 | Yamanaka et al. | 347/116 |
| 6,757,515 | B1 * | 6/2004 | Ueda | 399/396 |

* cited by examiner

*Primary Examiner*—Minh Chau
(74) *Attorney, Agent, or Firm*—Oblon, Spivak, McClelland, Maier & Neustadt, P.C.

(57) ABSTRACT

An image forming apparatus in which the rotational speed of register rollers is calculated at first to fourth stations at a transfer belt drive system, and transfer feedback control for varying the speed of a transfer drive motor is carried out on the transfer drive motor so that the speed of movement of a transfer belt is maintained at a predetermined value. The transfer feedback control is carried out on the image forming apparatus so as to vary the speed of the transfer drive motor so that the speed of movement of the transfer belt is maintained at a predetermined value or so as not to vary the speed of the transfer drive motor as a result of not carrying out the transfer feedback control.

5 Claims, 8 Drawing Sheets

METHOD FOR SETTING ROTATIONAL SPEED OF REGISTER ROLLERS AND IMAGE FORMING APPARATUS USING THE METHOD

CROSS-REFERENCE TO RELATED APPLICATION

The present application is Divisional of U.S. application Ser. No. 10/861,491, filed on Jun. 7, 2004, and in turn claims priority to Japanese Patent Application No. 2003-190539, filed on Jul. 2, 2003, and Japanese Patent Application No. 2003-307079, filed on Aug. 29, 2003, the entire contents of each of which are incorporated herein by reference.

BACKGROUND OF THE INVENTION

1. Field of the Invention

The present invention relates to a method for setting the rotational speed of register rollers for transporting a recording medium, such as a transfer sheet, at a predetermined timing, and an image forming apparatus, such as a copying machine, a printer, or a facsimile device, capable of using the method.

2. Description of the Related Art

Conventionally, many image forming apparatuses of this type which control a rotation start timing of register rollers to control the distance from an end of a recording medium to an image write position are known. Such image forming apparatuses are disclosed in, for example, Japanese Patent No. 2,709,218, and Japanese Unexamined Patent Application Publication Nos. 2000-159395 and 5-127484.

In general, in an apparatus, such as a monochromatic image forming apparatus, for directly transferring an image onto a recording medium from a single image carrier, the speed of movement of the surfaces of register rollers (hereinafter referred to as "register linear speed") is set slightly greater than the speed of movement of the surface of the image carrier. When the register linear speed is set slightly greater, the recording medium between the register rollers and a transfer area becomes flexed while the recording medium is passing through the transfer area. This makes it difficult for the register rollers to affect the recording medium in the transfer area. Consequently, since the register rollers do not easily affect the recording medium during transfer, a reduction in image quality caused by the effects of the register rollers can be restricted.

There is a strong demand for a color image forming apparatus to have higher printing speed. Therefore, in recent years, what is called a tandem color image forming apparatus using a direct transfer method is mainstream. The tandem color image forming apparatus is such that transfer areas of a plurality of image carriers are disposed above the transportation path of a recording medium. In the tandem color image forming apparatus, the recording medium is transported by being carried by a surface of a sheet transporting belt (member for transporting the recording medium). Then, toner images on the respective image carriers are successively transferred on the recording medium transported by the sheet transporting belt so as to be superimposed upon each other, as a result of which a color image is formed on the recording medium.

As in the monochromatic image forming apparatus, in such a tandem color image forming apparatus, when the register linear speed is set slightly greater than the speed of movement of the surface of the sheet transporting belt (belt movement speed), color misalignment occurs.

Hereunder, taking a tandem color image forming apparatus comprising four image carriers as an example, the reason why color misalignment occurs when the register linear speed is set greater than the speed of movement of the sheet transporting belt will be given. In the explanation below, the image carriers are called a first image carrier, a second image carrier, a third image carrier, and a fourth image carrier with increasing distance from the register rollers.

The recording medium transported by the register rollers is attracted to the sheet transporting belt, and is transported to the transfer area of each image carrier by the movement of the surface of the sheet transporting belt. Ideally, the recording medium and the sheet transporting belt are in complete contact with each other, and are not affected by disturbances at all. In this case, almost no color misalignment occurs. Actually, however, sliding of about a few $\mu$m to a few hundred $\mu$m occurs between the recording medium and the sheet transporting belt due to a disturbance. In addition, the belt movement speed may change due to a change in a load exerted upon the sheet transporting belt by a disturbance. Disturbances causing such sliding or changes in the belt movement speed are primarily caused by the effects of the register rollers driven at a linear speed that does not match the speed of movement of the sheet transporting belt.

More specifically, when the recording medium is transported by the register rollers driven at a register linear speed Vr, the recording medium is attracted to the sheet transporting belt driven at a belt movement speed Vt ($Vt<Vr$). Here, the speed of movement of the portion of the recording medium attracted to the sheet transporting belt is Vta ($Vt<Vta<Vr$) instead of the belt movement speed Vt. At this movement speed, an end of the recording medium moves into the transfer area of the first image carrier. Thereafter, as the recording medium is transported, the area of close contact between the recording medium and the sheet transporting belt increases, so that the speed of movement of the recording medium is controlled by the sheet transporting belt rather than the register rollers. By the time the end of the recording medium reaches the transfer area of the fourth carrier, the speed of movement of the recording medium is substantially equal to the movement speed Vt of the sheet transporting belt.

In a tandem color image forming apparatus, when the movement speeds of the recording medium passing the transfer areas of the respective image carriers are not the same, color misalignment occurs. In the aforementioned example, the movement speed of the recording medium is Vta when it passes the transfer area of the first image carrier. Thereafter, the movement speed of the recording medium is gradually reduced from Vta and becomes Vt when it passes the transfer area of the fourth image carrier. Therefore, the tone images of respective colors transferred from the respective image carriers are transferred to locations that are displaced from each other in correspondence with the speed differences, thereby resulting in color misalignment.

Based on the foregoing discussion, it can be understood that in order to form a high-quality image without color misalignment by a tandem color image forming apparatus, the register linear speed and the movement speed of the sheet transporting belt need to be set equal to each other with high precision. A method for performing feedback control on the driving of the sheet transporting belt in order to set its target value at the register linear speed is effective in making the speeds equal to each other with high precision. According to this method, feedback control makes it possible to absorb a slight difference between the movement speed of the sheet transporting belt and the register linear speed caused by, for example, the imprecision in manufacturing the sheet transporting belt itself, or the imprecision in the parts or the mounting of the parts of a drive system of the sheet transporting belt. Therefore, even if any of the aforementioned imprecisions occur slightly, the movement speed of the sheet transporting belt and the register linear speed can be set at values close enough to sufficiently restrict color misalignment.

Research conducted by the inventor showed that, if the operating environment changes, it is difficult to set the movement speed of the sheet transporting belt and the register linear speed at sufficiently close values even if feedback control is carried out. The reason is as follows.

If the operating environment is a constant environment (such as normal temperature and normal humidity), a range of a difference between the movement speed of the sheet transporting belt and the register linear speed capable of being absorbed by feedback control is relatively wide. However, if the operating environment deviates from the constant environment, this range is narrowed. Therefore, even if the movement speed of the sheet transporting belt and the register linear speed are set at sufficiently close values by feedback control when the operating environment is constant, it is difficult to set them at sufficiently close values when the operating environment changes.

SUMMARY OF THE INVENTION

Accordingly, the present invention is achieved in view of the above-described background. It is an object of the present invention to provide a method for setting the rotational speed of register rollers so that, even if, for example, the temperature or humidity of the environment changes, the speed of movement of a surface of a member for transporting a recording medium is stably maintained with high precision at the speed of movement of the surfaces of the register rollers, and to provide an image forming apparatus using this method.

In accordance with the present invention, there is provided a method for setting the rotational speed of register rollers in an image forming apparatus for forming an image by driving a recording medium transporting member while feedback control is carried out. The image forming apparatus comprised an image carrier for carrying a toner image, the register rollers for transporting recording media at a predetermined timing by rotationally driving the register rollers, the recording medium transporting member for carrying the recording media transported from the register rollers on its surface to pass the recording media by a transfer area opposing the image carrier, a driving device for driving the recording medium transporting member so that its surface moves, a detecting device for detecting the speed of movement of the surface of the recording medium transporting member, and a controller for feedback controlling the driving device based on the detection by the detecting device so that the speed of movement of the surface of the recording medium transporting member is kept at a target value equal to the speed of movement of the surfaces of the register rollers. The method comprises the steps of transferring toner marks on the image carrier onto the recording media transported at different rotational speeds by rotationally driving the register rollers at the different rotational speeds while the feedback control is not carried out, detecting displacements of the toner marks transferred on the recording media from ideal transfer positions, and setting the rotational speed of the register rollers for a subsequent image forming operation to the rotational speed of the register rollers when the displacement is smallest.

In accordance with the present invention, there is also provided a method for setting the rotational speed of register rollers in an image forming apparatus for forming an image by driving a recording medium transporting member while feedback control is carried out. The Image forming apparatus comprises an image carrier for carrying a toner image, the register rollers for transporting recording media at a predetermined timing by rotationally driving the register rollers, the recording medium transporting member for carrying the recording media transported from the register rollers on its surface to pass the recording media by a transfer area opposing the image carrier, a driving device for driving the recording medium transporting member so that its surface moves, a detecting device for detecting the speed of movement of the surface of the recording medium transporting member, and a controlling device for feedback controlling the driving device based on the detection by the detecting device so that the speed of movement of the surface of the recording medium transporting member is kept at a target value equal to the speed of movement of the surfaces of the register rollers. The method comprises the steps of measuring the speed of movement of the surface of the recording medium transporting member prior to replacing at least one of the driving device, the recording medium transporting member, and the register rollers with respect to the body of the apparatus, in which when the driving device is replaced, at least one of or all components of the driving device are replaced, storing the measured speed of movement of the surface of the recording medium transporting member, measuring the speed of movement of the surface of the recording medium transporting member after the replacement, comparing the speed of movement of the surface of the recording medium transporting member before the replacement with that after the replacement, and setting a value equal to the product of a set rotational speed of the register rollers and the ratio of the surface movement speed after the replacement to the surface movement speed before the replacement as the rotational speed of the register rollers for a subsequent image forming operation if the surface movement speeds before and after the replacement differ.

In accordance with the present invention, there is also provided an image forming apparatus for forming an image by driving a recording medium transporting member while feedback control is carried out. The image forming apparatus comprises an image carrier for carrying a toner image, register rollers for transporting recording media at a predetermined timing by rotationally driving the register rollers, the recording medium transporting member for carrying the recording media transported from the register rollers on its surface to pass the recording media by a transfer area opposing the image carrier, a driving device for driving the recording medium transporting member so that its surface moves, a detecting device for detecting the speed of movement of the surface of the recording medium transporting member, a controller for feedback controlling the driving device based on the detection by the detecting device so that the speed of movement of the surface of the recording medium transporting member is kept at a target value equal to the speed of movement of the surfaces of the register rollers, and a switching device for switching between an ON mode in which toner is transferred onto the recording media carried by the recording medium transporting member driven while the feedback control is carried out and an OFF mode in which toner is transferred onto the recording media carried by the recording medium transporting member when the feedback control is not carried out.

In accordance with the present invention, there is also provided an image forming apparatus for forming an image by driving a recording medium transporting member while feedback control is carried out. The image forming apparatus comprises an image carrier for carrying a toner image, register rollers for transporting recording media at a predetermined timing by rotationally driving the register rollers, the recording medium transporting member for carrying the recording media transported from the register rollers on its surface to pass the recording media by a transfer area opposing the image carrier, a driving device for driving the recording medium transporting member so that its surface moves, a detecting device for detecting the speed of movement of the surface of the recording medium transporting member, a controller for feedback controlling the driving device based on the detection by the detecting device so that the speed of movement of the surface of the recording medium transporting member is kept at a target value equal to the speed of movement of the surfaces of the register rollers, a storing device for storing the speed of movement of the surface of the recording medium transporting member measured prior to replacing at least one of the driving device, the recording medium transporting member, and the register rollers with respect to the body of the apparatus, in which when the driving device is replaced, at least one of or all components of the driving device are replaced, and a setting device for setting a value equal to the product of a set rotational speed of the register rollers and the ratio of the surface movement speed after the replacement to the surface movement speed before the replacement as the rotational speed of the register rollers for a subsequent image forming operation if the surface movement speeds before and after the replacement differ as a result of comparing the speed of movement of the surface of the recording medium transporting member before the replacement with that after the replacement.

BRIEF DESCRIPTION OF THE DRAWINGS

The above and other objects, features and advantages of the present invention will be come more apparent from the following detailed description taken with the accompanying drawings in which.

DESCRIPTION OF THE PREFERRED EMBODIMENTS

Hereunder, a description of embodiments of the present invention will be given in detail.

First Embodiment

Figure 1:
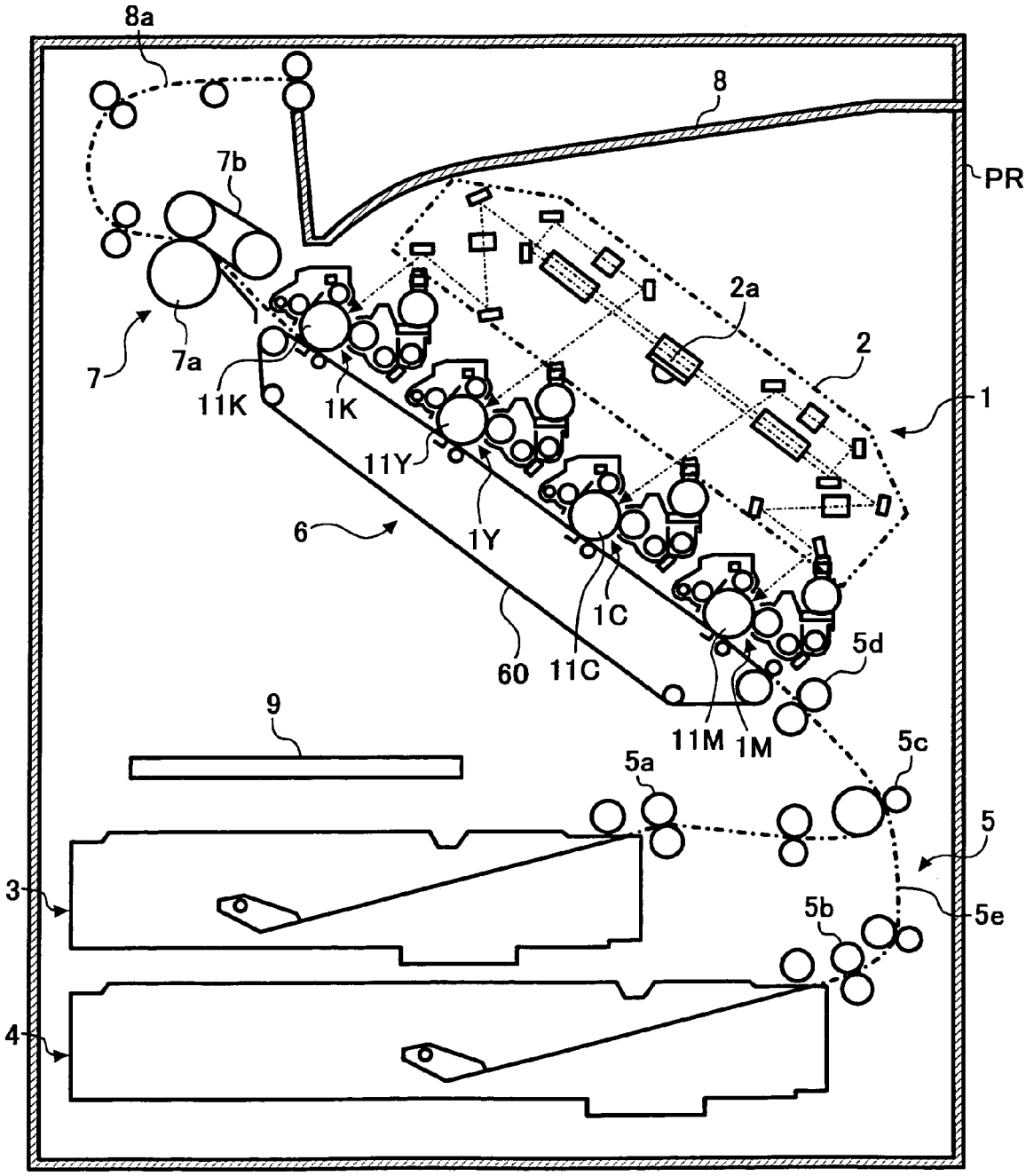
FIG. 1 is a schematic view of the structure of a color printer which is an image forming apparatus of a first embodiment of the present invention.

FIG. 1 is a schematic view of the structure of a quadruple tandem color printer which is an image forming apparatus of a first embodiment. A color printer PR primarily comprises an image-forming section 1, an optical writing section 2, first and second sheet-feed trays 3 and 4, a sheet-feeding section 5, a transfer section 6, a fixing section 7, and a sheet-discharge section 8. The color printer PR forms an image onto a recording sheet, which is a recording medium, supplied from the sheet-feed tray 3 or sheet-feed tray 4 at the lower portion of the color printer PR, and discharges the sheet to the sheet-discharge section (tray) 8 at the upper portion of the color printer PR.

The image-forming section 1 comprises first, second, third, and fourth image forming stations 1M, 1C, 1Y, and 1K which form images using magenta (M) toner, cyan (C) toner, yellow (Y) toner, and black (K) toner, respectively. The first image forming station 1M, the second image forming station 1C, the third image forming station 1Y, and the fourth image forming station 1K are all removable from the body of the color printer PR, thereby facilitating maintenance involving, for example, the replacement of components of the respective image forming stations 1M, 1C, 1Y, and 1K.

Figure 2:
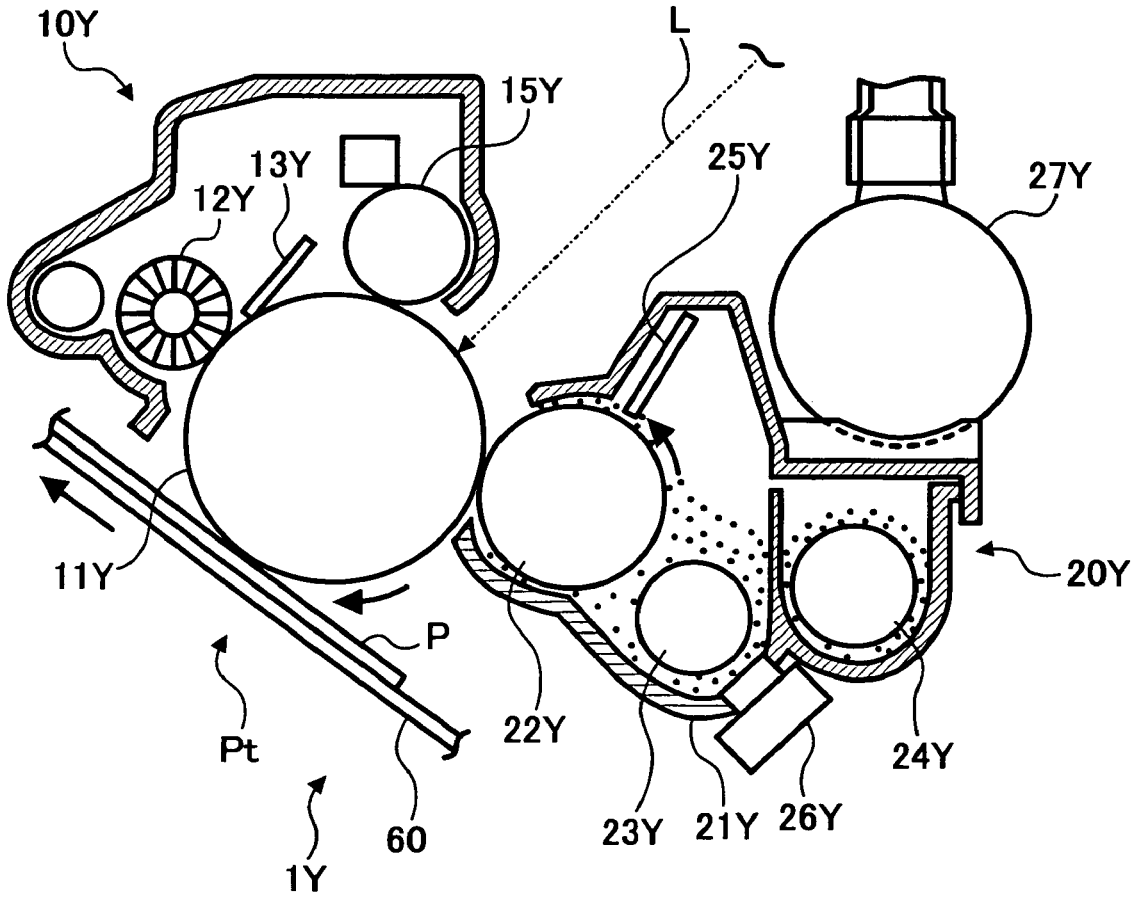
FIG. 2 shows in detail the structure of a third image forming station of the color printer.

FIG. 2 shows a detailed structure of the third image forming station 1Y. As shown in FIG. 2, in the third image forming station 1Y, a charging/cleaning unit 10Y and a developing unit 20Y (serving as developing means) are disposed around a photosensitive member 11Y serving as an image carrier. The surface of the photosensitive member 11Y is irradiated with laser light L for optical writing from a location between the charging/cleaning unit 11Y and the developing unit 20Y.

The charging/cleaning unit 11Y comprises a charge roller 15Y (serving as uniform charging means), a cleaning brush 12Y (serving as cleaning means), and a removing pawl 13Y. The charge roller 15Y uniformly charges the surface of the photosensitive member 11Y. The cleaning brush 12Y collects any residual toner on the photosensitive member 11Y. Any residual toner which could not be collected is removed by the removing pawl 13Y. Therefore, the surface of the photosensitive member is in a state allowing a next image forming operation to be performed.

The developing unit 20Y primarily comprises a developing roller 22Y, an agitating roller 23Y, a transporting roller 24Y, a doctor blade 25Y, a toner concentration sensor 26Y, and a toner bottle 27Y. These components are accommodated in or disposed at a developing tank 21Y. Toner supplied into the developing tank 21Y from the toner bottle 27Y is conveyed towards the agitating roller 23Y while being agitated by the transporting roller 24Y, and is further agitated by the agitating roller 23. By the agitations, the toner which is given an electrical potential by being charged by friction is conveyed towards the developing roller 22Y.

The toner conveyed to the surface of the developing roller 22Y is regulated to a predetermined layer thickness by the doctor blade 25Y, and is conveyed to a development area opposing the photosensitive member 11Y by the rotation of the developing roller 22Y. At this development area, a latent image formed by the aforementioned optical writing is developed by the toner, so that a toner image is formed. The toner image formed on the surface of the photosensitive member in this way is transferred onto a recording sheet P carried and transported by a sheet transporting belt 60 (recording medium transporting member) at a transfer area opposing the sheet transporting belt 60.

Any residual toner on the surface of the photosensitive member 11Y is collected by the cleaning brush 12Y. Any toner that could not be collected by the cleaning brush 12Y is removed from the surface of the photosensitive member 11Y by the removing pawl 13Y. The other stations 1M, 1C, and 1K have features similar to those of the third image forming station 1Y described with reference to FIG. 2.

In the optical writing section 2, a double polygon mirror 2*a* is used, and write optical paths are independently disposed for the four colors, respectively. As described above, the optical writing section 2 performs optical writing by irradiating the photosensitive member 11Y with the laser light L from a location between the charging roller 15 and the developing roller 22 in the image forming station 1Y, and by irradiating photosensitive members 1M, 11C, and 11K with the laser light L from locations between charging rollers 15 and respective developing rollers 22 in the respective image forming stations 1M, 1C, and 1K.

The sheet-feeding section 5 comprises sheet-feed rollers 5*a* and 5*b*, sheet-feed rollers 5*c*, and register rollers 5*d*. The sheet-feed rollers 5*a* and 5*b* pick up recording sheets P from the sheet-feed trays 3 and 4, respectively. The sheet-feed rollers 5*c* are disposed along a sheet-feed path 5*e*. The register rollers 5*d* are disposed just preceding the upstream side of the image forming section 1 in the direction of transportation of the recording sheets. The register rollers 5*d* are driven at a constant surface movement speed (register linear speed) by driving means (not shown). In the first embodiment, the register linear speed can be changed by a controlling unit (described later) serving as means for changing the rotational speed of the register rollers. In manually changing a set value of the register linear speed, when an operator inputs a predetermined set value by operating, for example, a numerical keypad disposed at the color printer PR as inputting means, the controlling unit serving as setting means changes a set value of the register linear speed in accordance with the input set value. The predetermined set value may be input from an external device, such as a personal computer, connected to an external interface (inputting means) of the color printer PR.

The register rollers 5*d* start transporting a recording sheet P in accordance with a timing in which an end of a toner image on the photosensitive member. 11M of the first image-forming station 1M moves into a transfer area. The recording sheet P transported by the register rollers 5*d* and attracted to the surface of the sheet transporting belt 60 is transported by the movement of the surface of the sheet transporting belt 60. During the transportation, the toner image formed on the photosensitive member 11M of the corresponding color in the image forming station 1M and toner images formed on the photosensitive members 11C, 11Y, and 11K in the respective image forming stations 1C, 1Y, and 1K are successively transferred onto the recording sheet so as to be superimposed upon each other. The recording sheet P having the toner images of the aforementioned colors transferred thereon is then sent to the fixing section 7 in order to perform a fixing operation thereon.

The fixing section 7 comprising a heat roller 7*a* and a fixing belt 7*b* is publicly known. The recording sheet P on which the fixing has been performed is discharged to the sheet-discharge tray 8 through a sheet-discharge path 8*a*.

Figure 3:
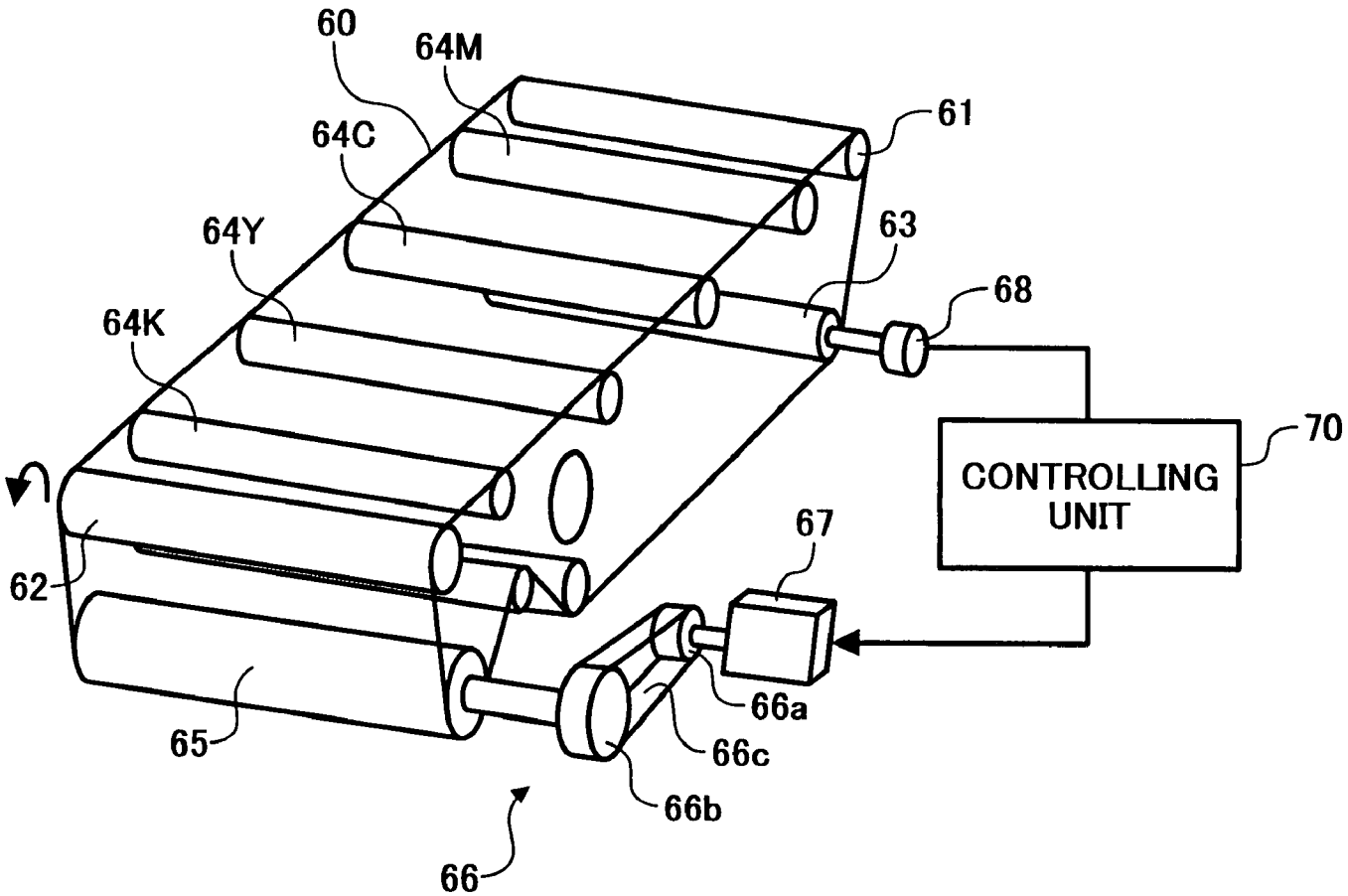
FIG. 3 shows a drive system of a sheet transporting belt installed in the color printer.

FIG. 3 shows the structure of a drive system of the sheet transporting belt 60. For the sake of explanation, the sheet transporting belt 60 is shown transparently.

The sheet transporting belt 60 is stretched upon an entrance roller 61 (disposed at the recording sheet entering side), an exit roller 62 (disposed at the sheet discharging side), a lower right roller 63, a drive roller 65, etc. The drive roller 65 is connected a pulse drive motor 67 through a speed reduction mechanism 66. The speed reduction mechanism 66 comprises a drive belt 66*c* stretched between a small pulley 66*a* and a large pulley 66*b*. In the first embodiment, means for driving the sheet transporting belt 60 comprises the drive roller 65, the speed reduction mechanism 66, and the pulse drive motor 67. An attraction roller (not shown) for charging a recording sheet and attracting the charged recording sheet to the sheet transporting belt 60 is disposed at the side of the entrance roller 61 where the photosensitive members 11 are disposed. A bias supply is connected to the attraction roller to predeterminately charge it. The recording sheet transported by the register rollers 5*d* is transported to a nipping section between the entrance roller 61 and the attraction roller, is charged as mentioned above, and is attracted to the sheet transporting belt 60. The movement of the surface of the sheet transporting belt 60 causes the recording sheet to be transported to the first image forming station 1M.

Transfer rollers 64M, 64C, 64Y, and 64K are disposed on portions of the inner peripheral surface of the sheet transporting belt 60 opposing the photosensitive members 11M, 11C, 11Y, and 11K of the respective image forming stations 1M, 1C, 1Y, and 1K. A transfer bias voltage is applied to the transfer rollers 64M, 64C, 64Y, and 64K. This causes a transfer electrical field to be formed in the transfer areas, so that the toner images of the aforementioned colors are transferred onto the recording sheet P that is transported while being attracted to the sheet transporting belt 60. A cleaning roller (not shown) is disposed so as to oppose a portion of the belt at the upstream side of the entrance roller 61 and at the downstream side of the exit roller 62 in the direction of movement of the sheet transporting belt 60. By applying a bias voltage to the cleaning roller from a bias supply, any toner on the surface of the sheet transporting belt 60 is removed therefrom.

Here, a controlling unit 70 carries out feedback control so that the pulse drive motor 67 is driven at a drive speed of a predetermined target value. Therefore, the speed of movement of the surface of the sheet transporting belt 60 (belt movement speed) is maintained at a substantially constant speed equal to the register linear speed (predetermined speed). That is, the belt is driven at a speed of 125 mm/sec.

More specifically, in the first embodiment, an output from an encoder 68 serving as detecting means disposed at the lower right roller 63 is transmitted to the controlling unit 70 serving as feedback controlling means. Based on the encoder output, the speed of movement of the sheet transporting belt 60 can be known. The controlling unit 70 compares the encoder output and a target value required to drive the sheet transporting belt 60 at a movement speed equal to the register linear speed. Then, it outputs a drive pulse for reducing the difference between the two values to zero to the pulse drive motor 67. In the first embodiment, such feedback control is carried out every second.

Figure 4:
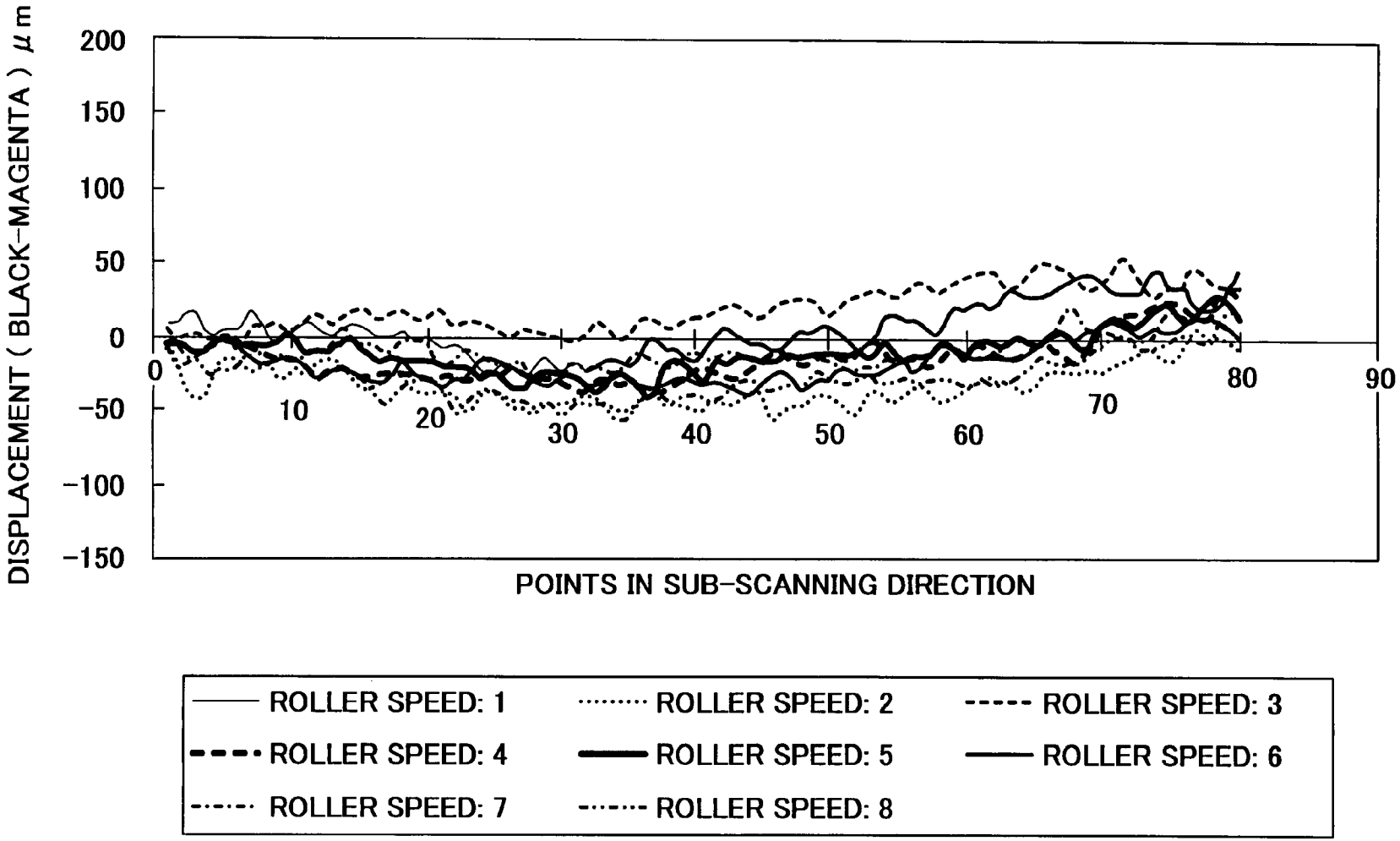
FIG. 4 is a plot of the displacements of K toner marks from M toner marks transferred and output on recording media while changing the register linear speed in predetermined increments using the color printer.

FIG. 4 is a plot of the displacements of K toner marks from M toner marks transferred and output onto recording sheets while changing the register linear speed in predetermined increments under normal temperature and normal humidity. The increment width is approximately 0.1% with respect to the register linear speed serving as a reference. Centered on the reference register linear speed, eight register linear speeds are measured. This measurement is carried out under normal temperature and normal humidity using A3 size recording sheets. The toner marks of these colors function as a displacement detection pattern which is long in a direction perpendicular to the direction of transportation of the recording sheets (subscanning direction) and which are arranged along the direction of transportation of the recording sheets. As can be seen from the graph, although there are slight variations in the displacements depending upon the linear speeds of the register rollers, the displacements are approximately 0 for any register linear speed. Therefore, color misalignment is restricted. This is achieved because the sheet transporting belt 60 can be driven at a substantially constant speed by sufficiently restricting variations in the speed of the sheet transporting belt 60 by the aforementioned feedback control.

Next, the method for setting the rotational speed of the register rollers, which is a feature of the first embodiment, will be described.

Figure 5:
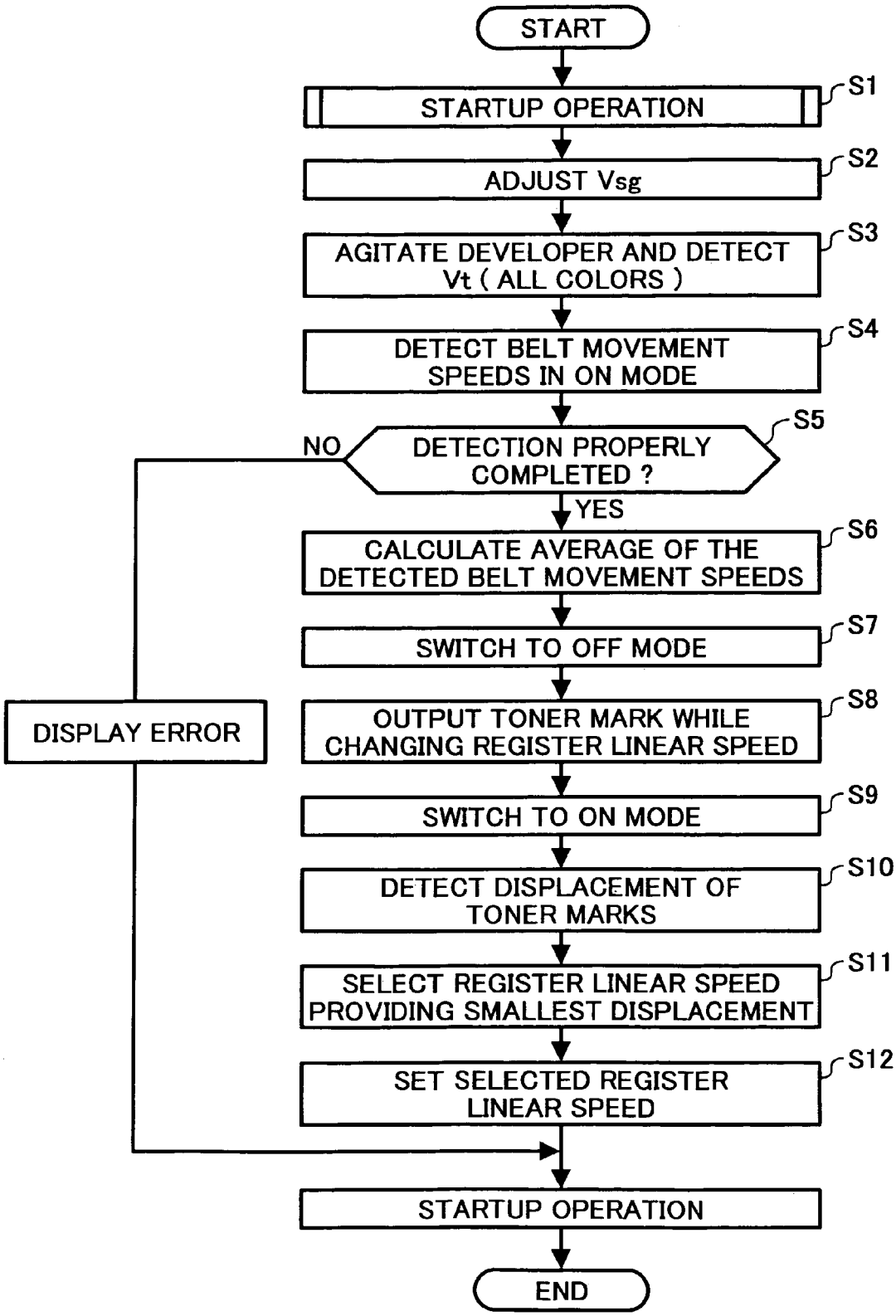
FIG. 5 is a flowchart of the process of setting the register linear speed executed by the color printer of the first embodiment.

FIG. 5 is a flowchart of the process of setting the register linear speed for executing the method for setting the rotational speed of the register rollers in the first embodiment. Hereunder, the case in which the process of setting the register linear speed is executed immediately after a power supply of the color printer PR is turned on will be described. Actually, however, the setting operation is not executed every time the color printer PR is started. For example, the setting operation is executed when it is necessary to adjust the rotational speed of the register rollers 5*d*, such as at the time of shipment of the color printer PR from a factory, or after replacement of, for example, the sheet transporting belt 60, the speed reduction mechanism 66, the pulse drive motor 67, or the register rollers 5*d*. In such a case, the process of setting the register linear speed is automatically proceeded to.

When the operator turns on the power supply of the color printer PR, the controlling unit (not shown) controls each part and executes start-up steps (Steps S1 to S3) so that the color printer PR is capable of forming an image. Thereafter, a register linear speed adjustment pattern output mode is set. In this mode, first, with the aforementioned feedback control carried out (ON mode), the aforementioned toner marks are transferred and output onto recording sheets, and movement speeds of the sheet transporting belt 60 are detected and stored (Step S4). More specifically, the controlling unit 70 samples an encoder output within a predetermined sampling period, and stores this in, for example, NVRAM. Then, when the detection of the belt movement speeds is completed properly (Step S5), the average of the stored belt movement speeds is calculated (Step S6). More specifically, the controlling unit 70 calculates the average period of the sampled encoder output as the average of the belt movement speeds.

Here, the sampling period is determined as follows.

Figure 6A:
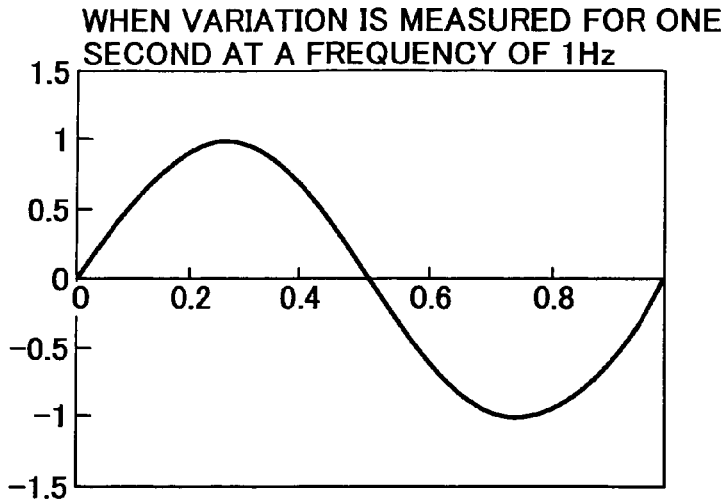
FIG. 6A is a graph of a variation in the speed of a small pulley of a speed reduction mechanism for one second.
Figure 6B:
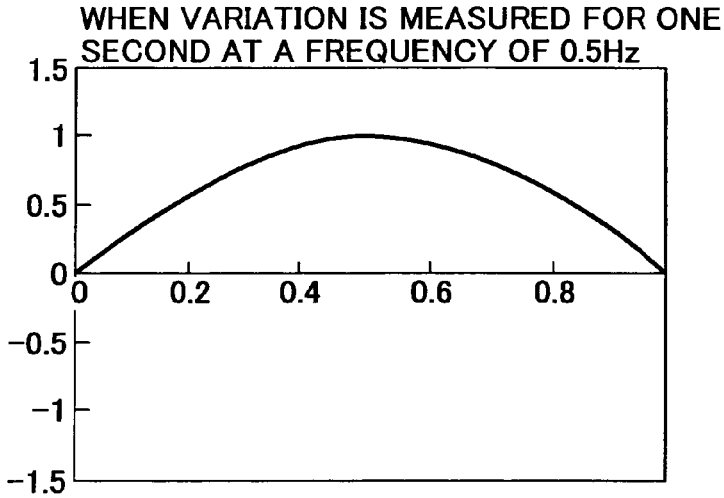
FIG. 6B is a graph of a variation in the speed of a large pulley of the speed reduction mechanism for one second.
Figure 6C:
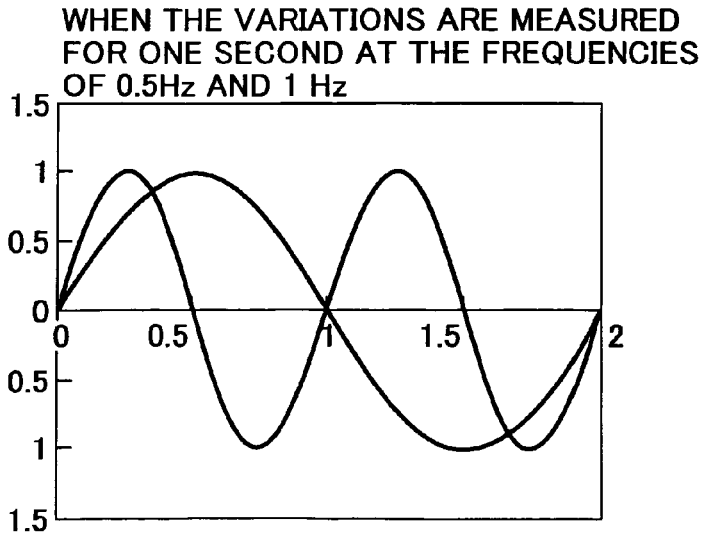
FIG. 6C is a graph of both waveforms shown in FIGS. 6A and 6B superimposed upon each other.

FIG. 6A is a graph of a variation in the speed of the small pulley 66*a* of the speed reduction mechanism 66 for one second. FIG. 6B is a graph of a variation in the speed of the large pulley 66*b* of the speed reduction mechanism 66 for one second. FIG. 6C is a graph of both waveforms shown in FIGS. 6A and 6B superimposed upon each other.

As shown in FIG. 6A, the frequency in one rotation of the small pulley 66*a* is 1 Hz. As shown in FIG. 6B, the frequency in one rotation of the large pulley 66*b* is 0.5 Hz. The variations in the speeds of the pulleys 66*a* and 66*b* due to, for example, decentering are repeated at the respective frequencies for one rotation. These repeated variations appear as changes in the speed of movement of the sheet transporting belt 60. Therefore, in order to accurately calculate the average of the speeds of movement of the sheet transporting belt 60, it is desirable to calculate the average of the detected belt movement speeds within a time period in which the variations in the speeds of the pulleys 66*a* and 66*b* become zero.

Referring to the graph of FIG. 6A, when the variation in the speed of the small pulley 66*a* is measured for one second, the speed variation is zero. Referring to the graph of FIG. 6B, however, when the variation in the speed of the large pulley 66*b* is measured for one second, the variation in the speed does not become zero. In order for the variation to become zero, the variation must be measured for two seconds. Therefore, as shown in FIG. 6C, the time period in which the variations in the speeds of the pulleys 66*a* and 66*b* become zero at the frequencies for one rotation is the time period that is determined based on a least common multiple. The time period is equal to an integral multiple of the period of the variation in the belt movement speed caused by the variations in the speeds of the pulleys 66*a* and 66*b*.

In the first embodiment, when the sampling period is determined as a time that is a multiple of two seconds, it is possible to at least calculate the average of the belt movement speeds that are not affected by the variations in the speeds of the small pulley 66*a* and the large pulley 66*b* of the speed reduction mechanism 66.

In this way, when the average of the belt movement speeds is calculated with the feedback control carried out (Step S6), the controlling unit 70 functions as switching means to switch the ON mode to an OFF mode in which feedback control is not carried out (Step S7). Then, the controlling unit 70 functions as OFF mode controlling means and controls each part so that toner marks are transferred and output onto recording sheets while the register linear speed is changed in predetermined increments as in the measurement carried out to obtain the graph of FIG. 4 (Step. S8). By this, the toner marks are output onto the recording sheets transported at different register linear speeds, so that the toner marks of respective colors are formed on the recording sheets. When all of the recording sheets having the toner marks transferred thereon are discharged, the register linear speed adjustment pattern output mode ends. The controlling unit 70 automatically switches the OFF mode to the ON mode (Step S9).

Here, the most important end of the first embodiment is to cause the speed of movement of the sheet transporting belt 60 when feedback control is not carried out (OFF mode) and the speed of movement of the sheet transporting belt 60 when feedback control is carried out (ON mode) to be the same. In the first embodiment, the encoder 68 (detecting means) for carrying out feedback control is disposed in addition to the drive roller 65. In such a case, the speed of movement of the sheet transporting belt 60 is determined by the outside diameter of the drive roller 65 in the OFF mode, and is determined by the outside diameter of the lower right roller 63 where the encoder 68 is disposed in the ON mode. Therefore, when the belt movement speed when feedback control is carried out is not used as the belt movement speed in the OFF mode, an optimal register linear speed (described below) cannot be precisely selected.

To overcome this problem, in the OFF mode in the first embodiment, the average period of the encoder output sampled as the average of the belt movement speeds (of the ON mode) calculated in Step S6 is used as a period of the drive pulse output to the pulse drive motor 67 from the controlling unit 70.

Figure 7:
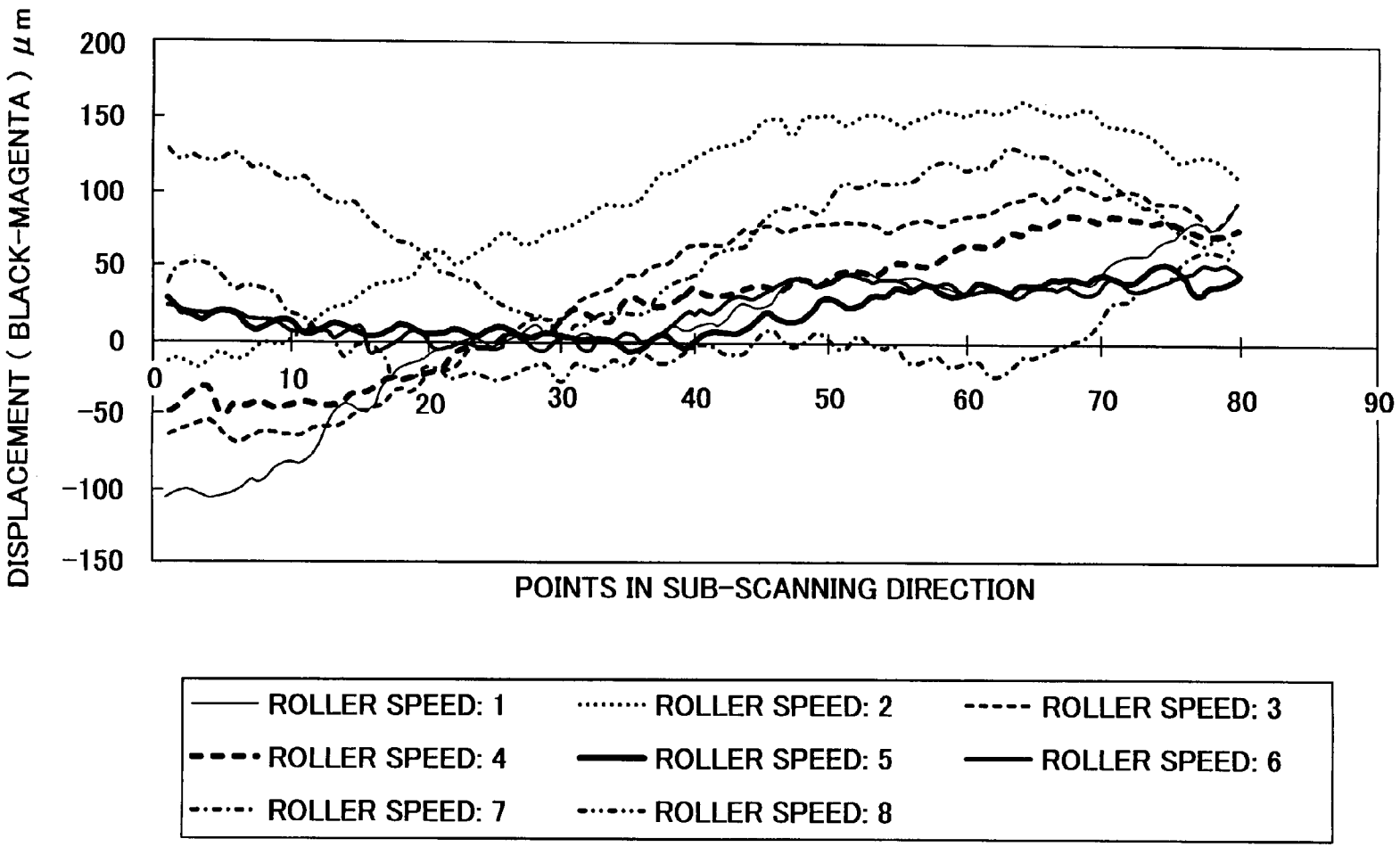
FIG. 7 is a plot of the displacements of K toner marks from M toner marks output when feedback control is not carried out using the color printer.

FIG. 7 is a plot of the displacements of K toner marks from M toner marks output when feedback control is not carried out under normal temperature and normal humidity. As can be seen by comparing the graph of FIG. 7 with the graph of FIG. 4, when feedback control is not carried out, under normal temperature and normal humidity, the magnitude of effect of the register rollers 5*d* that are driven at different linear speeds on the belt movement speed produced when feedback control is carried out is noticeable. In the first embodiment, the displacement of one toner mark from another toner mark on the recording sheet is smallest when the register rollers 5*d* are driven at a sixth register linear speed (indicated by a thick line in FIG. 7). Therefore, under normal temperature and normal humidity, the optimal register linear speed suitable for the belt movement speed produced when feedback control is carried out, that is, the register linear speed that least affects the belt movement speed produced when feedback control is carried out is the sixth register linear speed.

In the first embodiment, from the toner marks on respective recording sheets output in the aforementioned Step S8, the displacements plotted on the graph shown in FIG. 7 are detected (Step S10). The operator may carry out the detection by visual observation or by reading the toner marks on the respective recording sheets with image reading means (such as a scanner) and analyzing its image data. When the recording sheet having the least displacement between the toner marks is selected based on the detection results, a numerical keypad or the like disposed at the color printer PR is operated in order to select the register linear speed that is used when the recording sheet is output as the optimal register linear speed (Step S11). Information input by the operation of the numerical keypad or the like is sent to the controlling unit 70. The controlling unit 70 sets the register linear speed selected in accordance with the input information as the register linear speed for a subsequent image forming operation (Step S12).

Second Embodiment

Next, a second embodiment of the present invention will be described. The second embodiment is a preferred embodiment of the present invention, so that the present invention is not limited thereto. Therefore, various modifications may be made without departing from the gist of the present invention. The basic structure of a color printer of the second embodiment is similar to that of the color printer of the first embodiment. It only differs in the process of setting the register linear speed. Therefore, hereunder, only this difference will be described.

The second embodiment relates to adjusting the register linear speed after replacing a sheet transporting belt 60, its drive system, in particular, a lower right roller 63, where an encoder 68 is disposed, or register rollers 5*d*. When such a replacement is carried out, since an optimal register linear speed may change with respect to the speed of movement of the sheet transporting belt 60 (in an ON mode) after the replacement, color misalignment may occur if the register linear speed before the replacement is used. Therefore, after the replacement, it is necessary to execute a process of setting an optimal register linear speed. Although the optimal register linear speed may obviously be set after the replacement by the process of setting the register linear speed in the first embodiment, the optimal register linear speed is set by a different process of setting the register linear speed in the second embodiment.

Figure 8:
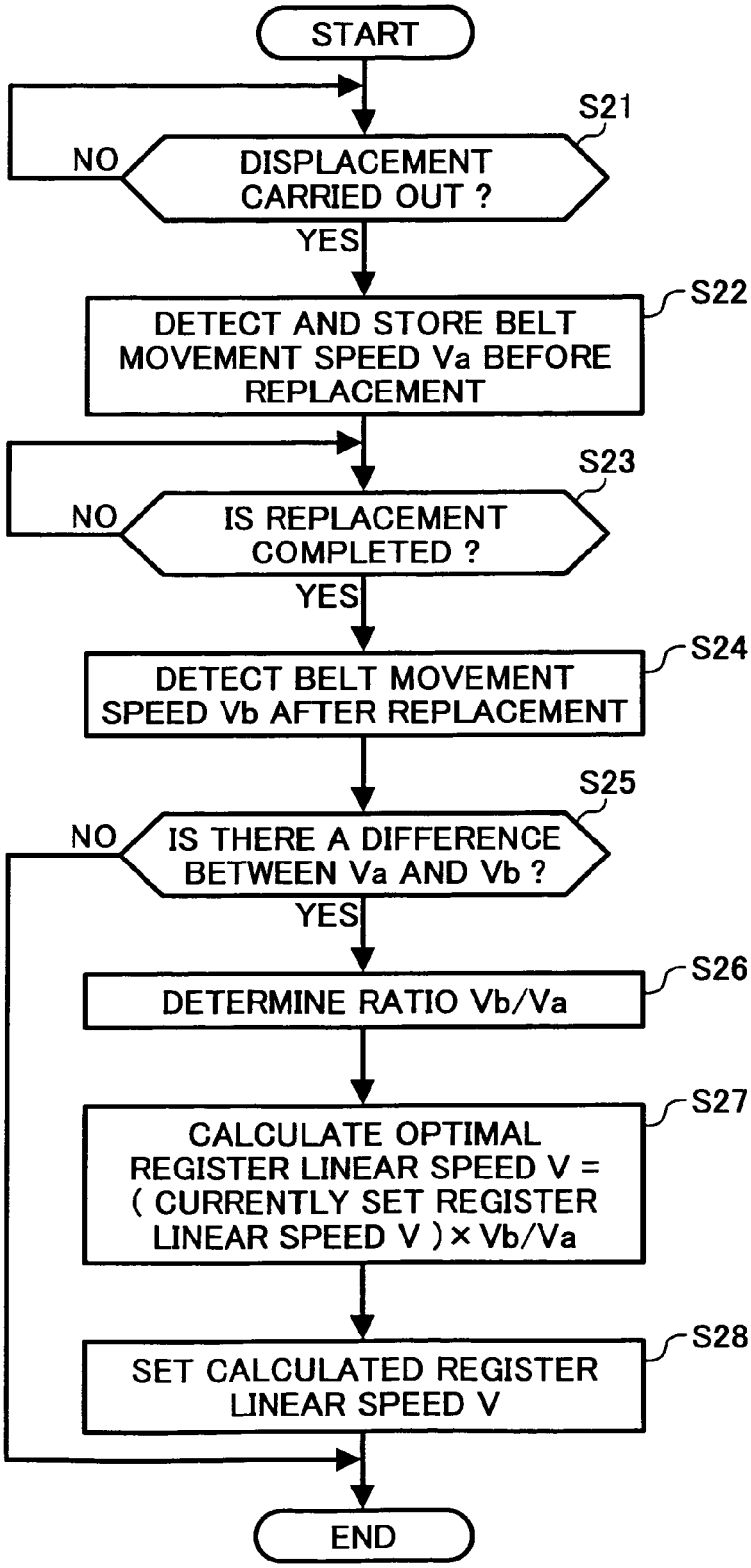
FIG. 8 is a flowchart of the process of setting the register linear speed executed by a color printer of a second embodiment of the present invention.

FIG. 8 is a flowchart of the mode of setting the register linear speed for executing a method for setting the rotational speed of the register rollers in the second embodiment.

In carrying out the aforementioned replacement, an operator inputs a command for the replacement by operating, for example, a numerical keypad of a printer PR. By the input, a controlling unit recognizes that the replacement is to be carried out (Step S21). As in the aforementioned Step S4 in the flowchart shown in FIG. 5, with feedback control carried out (ON mode), a movement speed Va of the sheet transporting belt 60 before the replacement is detected, and the detected speed Va is stored (Step S22). More specifically, in the second embodiment, the number of drive pulses output from a controlling unit 70 during the aforementioned sampling period is detected, and the detected number of pulses is stored.

Thereafter, the controlling unit 70 notifies the operator that preparation of the replacement is completed. When the operator finishes the replacement (Step S23), as in the case prior to the replacement, the controlling unit 70 detects a speed Vb of movement of the sheet transporting belt 60 that is, the number of pulses after the replacement (Step S24). Then, the controlling unit 70 compares the speeds Va and Vb, that is, the number of drive pulses before and after the replacement (Step S25). If the comparison shows that the speeds Va and Vb differ, the controlling unit 70 calculates a ratio Vb/Va, that is, a ratio between the numbers of drive pulses before and after the replacement (Step S26). The calculated ratio is multiplied to a currently set register linear speed (Step S27). The value obtained by the multiplication is set as the optimal register linear speed for a subsequent image forming operation (Step S28).

A more specific example will be given. Here, the number of drive pulses before the replacement stored in Step S22 is 1000. The register linear speed before the replacement is a design target value. If the number of drive pulses after the replacement detected in Step S24 is 1010, the ratio between the two values is 0.01. Therefore, after the replacement, feedback control is carried out to drive the sheet transporting belt 60 at a movement speed that is 1% greater than that before the replacement. Consequently, an optimal register linear speed V suitable for the belt movement speed is 0.01 times greater than a currently set register linear speed V' (register linear speed before the replacement). Accordingly, by setting the optimal register linear speed V, it is possible to restrict color misalignment in forming an image after the replacement.

The color printer PR of the first embodiment comprises the photosensitive members 11M, 11C, 11Y, and 11K, serving as image carriers for carrying toner images, and the register rollers 5*d* which are rotationally driven for transporting recording sheets (recording media) at a predetermined timing. The color printer PR also comprises the sheet transporting belt 60, serving as recording medium transporting member for carrying a recording sheet transported by the register rollers 5*d* and passing it by the transfer areas opposing the photosensitive members, and the drive roller 65, the speed reduction mechanism 66, and the pulse drive motor 67 serving as driving means for driving the sheet transporting belt 60 so that its surface moves. The color printer PR further comprises the encoder 68 serving as detecting means for detecting the speed of movement (surface movement speed) of the sheet transporting belt 60, and the controlling unit 70 serving as feedback controlling means for feedback controlling the pulse drive motor 67 based on the detection result of the encoder 68 so that the speed of movement of the sheet transporting belt 60 is maintained at a target speed equal to the register linear speed. The color printer PR carries out an image forming operation by driving the sheet transporting belt 60 with the feedback control carried out.

In the color printer PR of the first embodiment, when the aforementioned feedback control is not carried out, the register rollers 5*d* are driven at different rotational speeds in order to transfer toner marks on the photosensitive members 11M, 11C, 11Y, and 11K onto the recording sheets that are transported at different register linear speeds. Then, the displacement of the positions of the toner marks transferred on the respective recording sheets (that is, the transfer positions of the K toner marks) from the ideal positions (that is, the transfer positions of the M toner marks) are detected in order to set the linear speed of the register rollers 5*d* in a subsequent image forming operation at a value equal to the register linear speed when the displacement is smallest.

By setting the register linear speed by this method, even if the operating environment changes, the optimal register linear speed which makes it possible for a change in the speed of movement of the sheet transporting belt 60 to be smallest can be set. Therefore, the speed of movement of the sheet transporting belt 60 subjected to the aforementioned feedback control in a subsequent image forming operation is maintained with high precision at the same value as the register linear speed even if the operating environment changes compared to when the movement speed is equal to the other linear speeds.

The controlling unit 70 of the color printer PR of the first embodiment serves as mode switching means for switching between the ON mode in which toner is transferred onto a recording sheet carried by the sheet transporting belt 60 driven in a state in which feedback control is carried out and the OFF mode in which toner is transferred onto a recording sheet carried by the sheet transporting belt 60 driven in a state in which feedback control is not carried out. Accordingly, the optimal register linear speed can be set by the above-described method.

The controlling unit 70 of the color printer PR of the first embodiment serves as register rotational speed changing means for changing the linear speed of the register rollers 5*d* prior to transporting a recording sheet by the register rollers 5*d*. The controlling unit 70 makes it possible to set the optimal register linear speed by the above-described method.

The controlling unit 70 of the color printer PR of the first embodiment serves as OFF mode controlling means for controlling an image forming operation so that in the OFF mode the register linear speed is successively changed, and the toner marks on the photosensitive members 11M, 11C, 11Y, and 11K are transferred onto respective recording sheets transported by the register rollers 5*d* driven at the different linear speeds, and the recording sheets having the toner marks transferred thereon are discharged. Accordingly, it no longer is necessary for the operator to manually change and output the register linear speed, so that the working load on the operator, such as a service personnel at the market or a personnel for carrying out adjustment of the register linear speed, can be reduced. In particular, in the first embodiment, when the output by the controlling unit 70 is completed, the OFF mode automatically switches to the ON mode, so that the working load can be further reduced.

In the first embodiment, the toner marks transferred onto the recording sheets in the OFF mode function as a displacement detection pattern suitable for detecting the displacements of the toner marks. This makes it possible to detect the displacements more precisely.

The color printer PR of the first embodiment comprises a numerical keypad or the like serving as means for inputting a set value of the register linear speed from a personal computer (which is an external device) or by the operator, and the controlling unit 70 serving as means for setting the register linear speed for a subsequent image forming operation in accordance with the set value input from, for example, the numerical keypad. Accordingly, since the set optimal register linear speed can be externally input, the color printer PR does not need to comprise any of the means for determining the set optimal register linear speed by itself. Therefore, the structure of the color printer PR is simplified, so that manufacturing costs are reduced.

In the first embodiment, in the OFF mode, the sheet transporting belt 60 is driven so that the belt movement speed measured in the ON mode is reflected. This makes it possible to precisely select the optimal register linear speed as mentioned above.

In the first embodiment, the means for driving the sheet transporting belt 60 comprises the small pulley 66*a* and the large pulley 66*b* which are rotary members for transmitting drive force to the sheet transporting belt 60. In the OFF mode, the sheet transporting belt 60 is driven at the average of the belt movement speeds measured within a predetermined time of the ON mode. This predetermined time is set equal to an integral multiple of the period of variation of the speed of movement of the sheet transporting belt 60 which may occur due to the variations in the rotational speeds of the pulleys 66*a* and 66*b*. Therefore, as described above, the average value can be set more precisely.

In contrast, in the second embodiment, the movement speed Va of the sheet transporting belt 60 prior to replacing at least one of the driving means, the sheet transporting belt 60, and the register rollers 5*d* is measured and stored. When the driving means is replaced, at least one or all components of the driving means are replaced. Then, after the replacement, the movement speed Vb of the sheet transporting belt 60 is measured in order to compare the surface movement speed before the replacement and that after the replacement. If the comparison shows that these values differ, the ratio (Vb/Va) between the belt movement speeds after and before the replacement is multiplied to the set register linear speed, and the resulting value is set as the register linear speed for a subsequent image forming operation.

By setting the register linear speed by such a method, as described above, the register linear speed that affects the speed of movement of the sheet transporting belt 60 can be set at an optimal value in the first embodiment. Therefore, in a subsequent image forming operation, the speed of movement of the sheet transporting belt 60 that is subjected to the feedback control is maintained with high precision at the same value as the register linear speed even if the operating environment changes compared to when it is set at the other register linear speeds.

The color printer PR of the second embodiment comprises storage means for storing the belt movement speed measured before the replacement, and the controlling unit 70 serving as means for setting the value obtained by multiplying the ratio (Vb/Va) to the set register linear speed as the rotational speed of the register rollers for a subsequent image forming operation if a comparison between the stored belt movement speed Va before the replacement and the belt movement speed Vb after the replacement shows that these values are different. Accordingly, it is possible to set the optimal register linear speed by the above-described method.

In the first and second embodiments, the drive frequency of the pulse drive motor 67 used as driving means corresponds to the belt movement speed in the ON mode. By using the pulse drive motor 67 as means for driving the sheet transporting belt 60, the number of drive pulses (motor drive frequency) corresponds to the belt movement speed which is a storage parameter made use of in the above-described method. Since the controlling unit 70 generates the number of drive pulses, the average number of drive pulses when feedback control is carried out by the controlling unit 70 can be precisely determined. In general, since the number of drive pulses input to the pulse drive motor 67 is from thousands to tens of thousands of pulses, which is large, an error in the determined average value is small.

The color printer PR of the first embodiment comprises the photosensitive members 11M, 11C, 11Y, and 11K disposed along a recording sheet transportation path along which recording sheets are transported by the sheet transporting belt 60, and the color printer PR of the second embodiment comprises photosensitive members 11M, 11C, 11Y, and 11K disposed along a recording sheet transportation path along which recording sheets are transported by the sheet transporting belts 60. In the color printers PR of the first and second embodiments, toner images on the respective photosensitive members are successively transferred onto the recording sheets so as to be superimposed upon each other. Such printers are what are called tandem printers and are advantageous in that printing speeds are high, but have a serious problem in that color misalignment occurs due to displacements of the toner transferred on the recording sheets from the ideal positions. Therefore, applying the present invention to such tandem printers makes it possible to achieve image forming apparatuses which have high printing speed and which can output a high-quality image with a sufficiently reduced color misalignment.

The color printer PR of the first embodiment comprises the image forming stations 11M, 11C, 11Y, and 11K which are process cartridges in which are integrated in combination the photosensitive members 11M, 11C, 11Y, and 11K, and at least ones of the charge rollers 15M, 15C, 15Y, and 15K serving as means for uniformly charging the surfaces of the photosensitive members, the developing units 20M, 20C, 20Y, and 20K serving as means for developing latent images on the surfaces of the photosensitive members charged by the respective charge rollers to form toner images, the cleaning brushes 12M, 12C, 12Y, and 12K, serving as means for cleaning off any residual toner on the photosensitive members after transferring the toner images on the photosensitive members onto recording sheets, and the removing pawls 13M, 13C, 13Y, and 13K. The same applies to the color printer PR of the second embodiment. These image forming stations are removable from the bodies of the color printers PR of the first and second embodiments. As mentioned above, maintenance involving, for example, replacement of components of the image forming stations 1M, 1C, 1Y, and 1K in the first and second embodiments is facilitated.

As described above, according to the present invention, the rotational speed of the register rollers that affects the speed of movement of the surface of the recording medium transporting member can be set at an optimal value suitable for, for example, operating environments and belt driving conditions that differ according to individual image forming apparatuses. Therefore, it is possible to maintain the speed of movement of the surface of the recording medium transporting member at a predetermined speed with high precision.

Various modifications will become possible for those skilled in the art after receiving the teachings of the present disclosure without departing from the scope thereof.

What is claimed is:

1. A method for setting the rotational speed of register rollers in an image forming apparatus for forming an image by driving a recording medium transporting member while feedback control is carried out, the image forming apparatus comprising an image carrier for carrying a toner image, the register rollers for transporting recording media at a predetermined timing by rotationally driving the register rollers, the recording medium transporting member for carrying the recording media transported from the register rollers on its surface to pass the recording media by a transfer area opposing the image carrier, means for driving the recording medium transporting member so that its surface moves, means for detecting the speed of movement of the surface of the recording medium transporting member, and controlling means for feedback controlling the driving means based on the detection by the detecting means so that the speed of movement of the surface of the recording medium transporting member is kept at a target value equal to the speed of movement of the surfaces of the register rollers, the method comprising the steps of:

measuring the speed of movement of the surface of the recording medium transporting member prior to replacing at least one of the driving means, the recording medium transporting member, and the register rollers with respect to the body of the apparatus, in which when the driving means is replaced, at least one of or all components of the driving means are replaced, storing the measured speed of movement of the surface of the recording medium transporting member, measuring the speed of movement of the surface of the recording medium transporting member after the replacement, comparing the speed of movement of the surface of the recording medium transporting member before the replacement with that after the replacement, and setting a value equal to the product of a set rotational speed of the register rollers and the ratio of the surface movement speed after the replacement to the surface movement speed before the replacement as the rotational speed of the register rollers for a subsequent image forming operation if the surface movement speeds before and after the replacement differ.

2. An image forming apparatus for forming an image by driving a recording medium transporting member while feedback control is carried out, the image forming apparatus comprising:

an image carrier for carrying a toner image, register rollers for transporting recording media at a predetermined timing by rotationally driving the register rollers, the recording medium transporting member for carrying the recording media transported from the register rollers on its surface to pass the recording media by a transfer area opposing the image carrier, means for driving the recording medium transporting member so that its surface moves, means for detecting the speed of movement of the surface of the recording medium transporting member, controlling means for feedback controlling the driving means based on the detection by the detecting means so that the speed of movement of the surface of the recording medium transporting member is kept at a target value equal to the speed of movement of the surfaces of the register rollers, storing means for storing the speed of movement of the surface of the recording medium transporting member measured prior to replacing at least one of the driving means, the recording medium transporting member, and the register rollers with respect to the body of the apparatus, in which when the driving means is replaced, at least one of or all components of the driving means are replaced, and setting means for setting a value equal to the product of a set rotational speed of the register rollers and the ratio of the surface movement speed after the replacement to the surface movement speed before the replacement as the rotational speed of the register rollers for a subsequent image forming operation if the surface movement speeds before and after the replacement differ as a result of comparing the speed of movement of the surface of the recording medium transporting member before the replacement with that after the replacement.

3. The image forming apparatus as claimed in claim 2, wherein the driving means is a pulse drive motor, and the measured surface movement speed corresponds to a drive frequency of the pulse drive motor.

4. The image forming apparatus as claimed in claim 2, wherein a plurality of the image carriers are disposed along a transportation path of the recording media transported by the recording medium transporting member, and toner images on the image carriers are successively transferred onto the recording media so as to be superimposed upon each other.

5. The image forming apparatus as claimed in claim 2, further comprising a process cartridge including the image carrier integrated with at least one of charging means for uniformly charging the surface of the image carrier, developing means for developing a latent image on the surface of the image carrier charged by the charging means to form a toner image, and cleaning means for removing any residual toner on the image carrier after transferring the toner image on the image carrier onto the recording medium, the process cartridge being removable from the body of the image forming apparatus.

* * * * *